US005275281A

United States Patent [19]

Ebeling

[11] Patent Number: 5,275,281

[45] Date of Patent: Jan. 4, 1994

[54] MICROMETER ORGANIZING AND PROTECTING DEVICE

[76] Inventor: Keith R. Ebeling, P.O. Box 20505, Portland, Oreg. 97220

[21] Appl. No.: 914,312

[22] Filed: Jul. 17, 1992

[51] Int. Cl.[5] ..... B65D 85/28

[52] U.S. Cl. ..... 206/373; 206/564; D9/347; D3/74

[58] Field of Search ..... 206/372, 373, 375, 563, 206/564; 220/500, 507; 211/70.6; D9/341, 347; D3/74

[56] References Cited

U.S. PATENT DOCUMENTS

| | | | |
|---|---|---|---|
| D. 277,508 | 2/1985 | Clair | D9/341 |
| D. 283,083 | 3/1986 | Stednitz | D3/74 |
| D. 289,856 | 5/1987 | Easterling | D9/347 |
| 3,013,656 | 12/1961 | Murphy | 206/564 |
| 3,224,780 | 12/1965 | Mohl | 206/564 |
| 4,111,305 | 9/1978 | Thomas | 206/564 |
| 4,153,160 | 5/1979 | Leigh | 206/564 |
| 4,354,601 | 10/1982 | Harrison | 206/564 |
| 4,380,293 | 4/1983 | Wilcox et al. | 206/564 |
| 5,005,703 | 4/1991 | Bodker | 206/563 |

FOREIGN PATENT DOCUMENTS

| | | | |
|---|---|---|---|
| 2276148 | 1/1976 | France | 211/70.6 |
| 2559415 | 8/1985 | France | 211/70.6 |

OTHER PUBLICATIONS

Brookstone Catalog, p. 3, 1983 "A big tool kit".

*Primary Examiner*—David T. Fidei

*Attorney, Agent, or Firm*—Eugene M. Eckelman

[57] ABSTRACT

A plate-like device has six recesses in its top surface for holding in face up relation a set of six commonly used micrometers of from 0–25.4 mm (0–1") through 127.0–152.4 mm (5–6"). The width and length dimensions of the holder are approximately 187.325 mm (7⅜") by 625.476 mm (24⅝), respectively, and the recesses are specifically arranged to be contained in an area of this size as well as being arranged in continuously ascending order from one end to the other. The particular dimensions of the device allow it to be inserted in and removed from a conventional tool box drawer in a snug fit. It is rigid so as to be self-standing and supporting when out of a tool box drawer and has finger notches for manual handling and removal and a side edge taper and bottom edge rounding for efficient insertion and removal relative to a drawer. The top surface of the device also has auxiliary recesses for holding calibrating standards and one or more adjusting wrenches. Finger wells are provided in the recesses to facilitate clearance for grasping the items in the recesses.

5 Claims, 3 Drawing Sheets

MICROMETER ORGANIZING AND PROTECTING DEVICE

BACKGROUND OF THE INVENTION

This invention relates to a new and useful micrometer organizing and protecting device.

Various occupations use micrometers for taking precision measurements. Micrometers that are mostly used for this purpose comprise outside type micrometers which have a C-shaped frame with a hardened anvil at one end and a thimble at the other end capable of adjustment to accurately read the position of a spindle operating across the open portion of the C-shaped frame with relation to the anvil. A ratchet knob projects from the thimble end and, similar to the spindle, moves longitudinally with turning movements of the thimble.

Although micrometers can be purchased in sizes that are very small to very large, the average set purchased by machine shops, mechanics, inspectors, technicians, etc. comprise a set of six, namely, 0-25.4 mm (0-1"), 25.4-50.8 mm (1-2") 50.8-76.2 mm (2-3"), 76.2-101.6 mm (3-4"), 101.6-127.0 mm (4-5"), and 127.0-152.4 mm (5-6"). Persons using these instruments usually keep them haphazardly in tool boxes that are sold in the trade in a common size, namely, tool boxes with shallow pull-out drawers having width and length dimensions of approximately 188.912 mm (7 7/16") and 627.064 mm (24 11/16"), respectively. In this type of storage of the micrometers, as well as storage of a spanner wrench used for adjustment and precision calibrating standards that are required for each micrometer, all are subjected to unnecessary and undesirable contact which leads to damage and unnecessary wear. In addition, any common readings that the workmen may repeatedly use must be re-checked each time the micrometers are removed since undesired adjustment of the thimble portion is likely to occur due to physical engagement of the micrometers with each other or with other tools. In addition, with the micrometers stored in a haphazard manner, not only is it time consuming to grasp them properly and safely but it is also time consuming to pick out the size desired.

SUMMARY OF THE INVENTION

Accordingly it is an object of the invention to provide a micrometer organizing and protecting device for removable support in conventionally sized tool boxes and capable of supporting and logically arranging six commonly used micrometers for damage-free spacing and ready viewing of the micrometer size and setting thereon, as well as for ready access to provide organized insertion and removal of the micrometers. The device also supports calibrating standards and adjusting wrench means for the micrometers.

In carrying out the objectives of the invention, the device of the invention comprises a plate-like member or tray having a top surface with recesses therein of predetermined size arranged to receive and support micrometers in face up, spaced, untouching relation. The recesses are selectively sized and arranged to support six micrometers in continuous and ascending size of 0-25.4 mm (0-1") to 127.0-152.4 mm (5-6") from one end of the device to the other. Finger wells that are deeper than the micrometer holding recesses are associated with the latter to allow easy removal and insertion of the micrometers. Additional recesses and finger receiving wells are also provided for the calibrating standards and one or more adjusting wrenches. The device is especially dimensioned to removably fit in the shallow drawers of commonly sized tool boxes and is provided with rounded bottom edges and also finger grip recesses on the rear side for easy insertion into and removal from the closely fitting drawer. Also, the device is rigid in construction whereby to be free standing and of sufficient strength when carried or supported only by its ends, as when removed from the drawer.

The invention will be better understood and additional objects and advantages will become apparent from the following description taken in connection with the accompanying drawings.

DETAILED DESCRIPTION OF A PREFERRED EMBODIMENT

Figure 1:
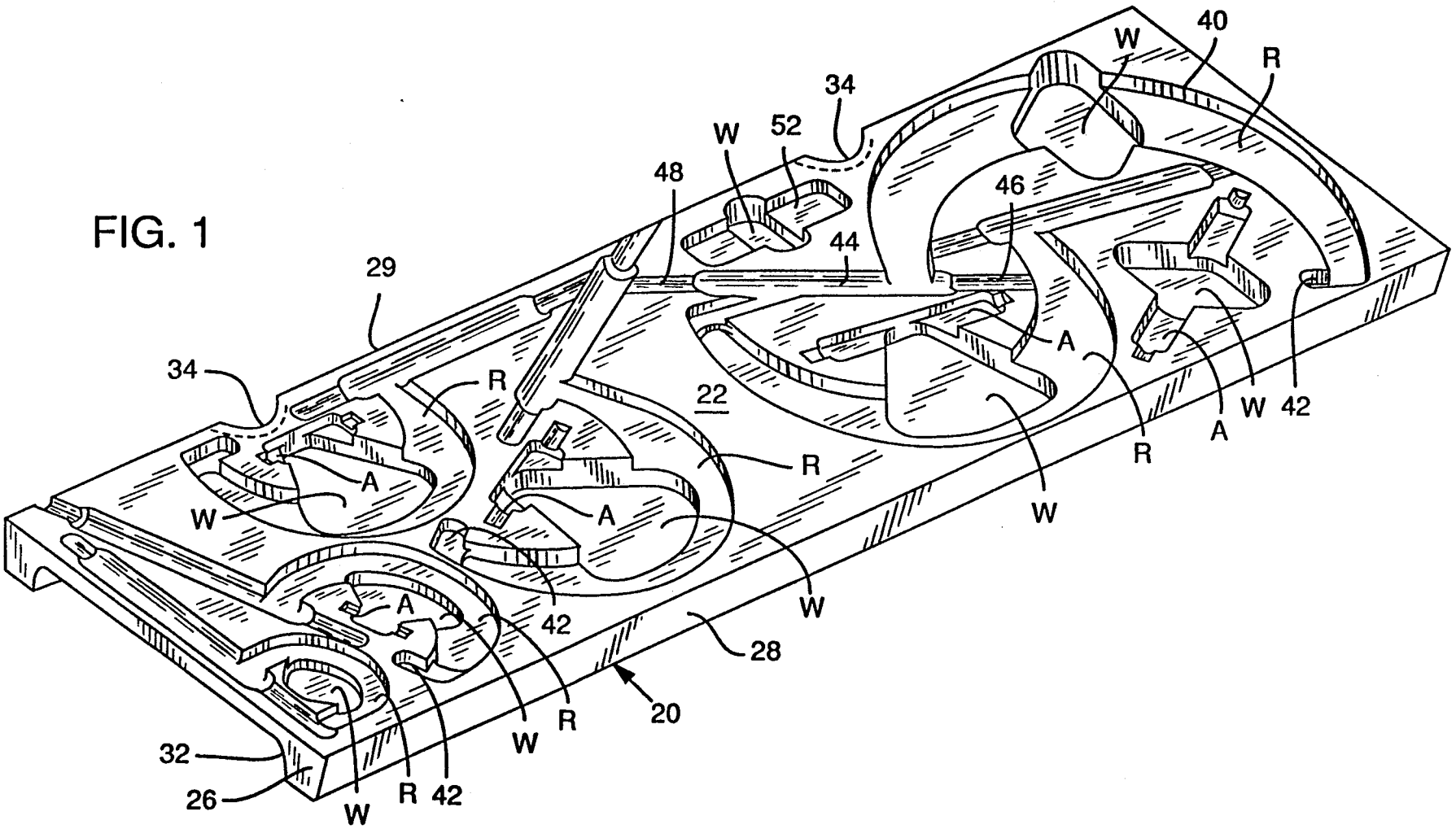
FIG. 1 is a perspective view of the device of the instant invention.
Figure 2:
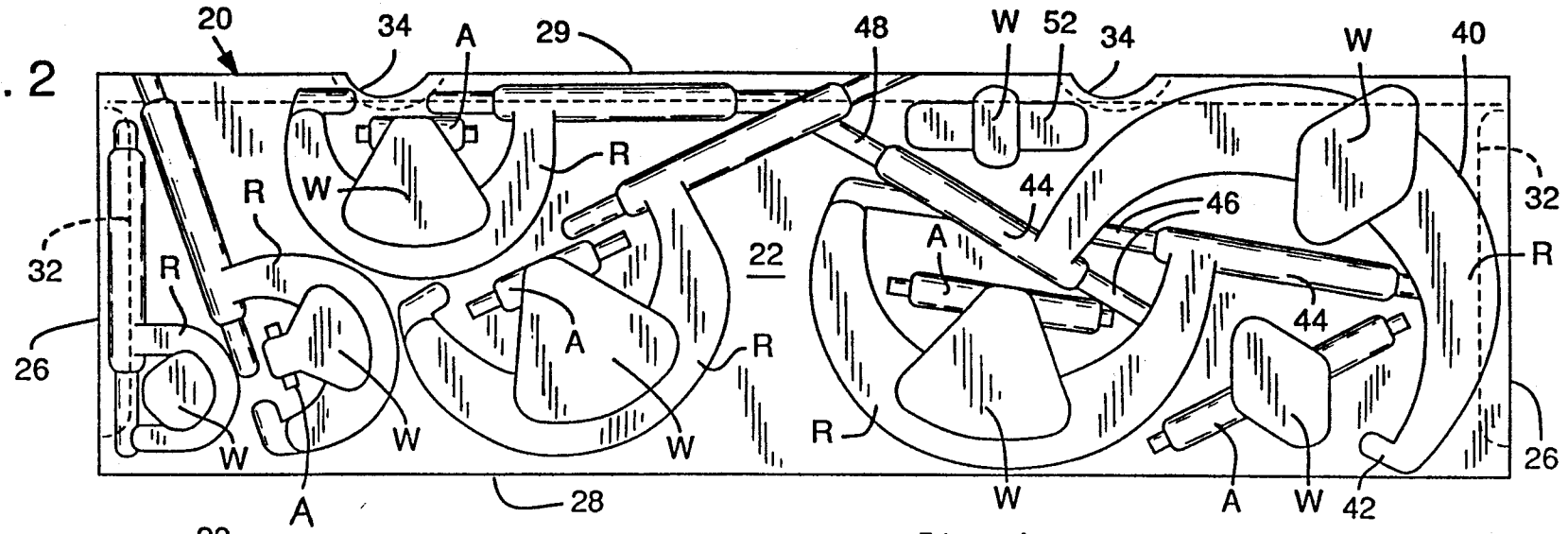
FIG. 2 is a plan view of the device.
Figure 3:
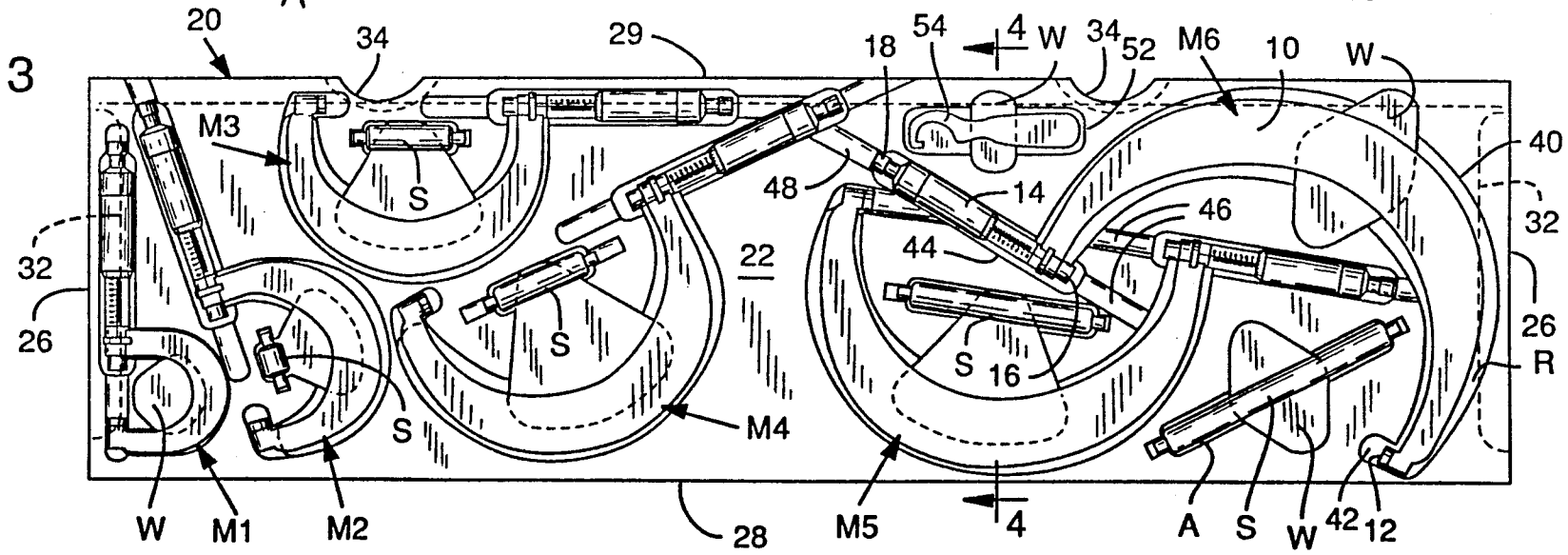
FIG. 3 is a view similar to FIG. 2 but showing micrometers, standards for the micrometers, and an adjusting wrench supported in the device.

The present device is particularly structured for removably storing a set of six commonly used micrometers M1, M2, M3, M4, M5 and M6, FIG. 3, of the outside type. The device is arranged to removably fit in a conventional tool box drawer 8, FIG. 5, that has inside width and length dimensions of approximately 188.912 mm (7 7/16") by 627.064 mm (24 11/16") and a height of approximately 31.75 mm (1¼"). The outside type micrometer has a C-shaped frame 10 that supports a hardened anvil 12 at one end and a thimble 14 at the other end. The numeral 16 in FIG. 3 designates the micrometer spindle and the numeral 18 designates the ratchet or friction adjusting mechanism.

Figure 4:
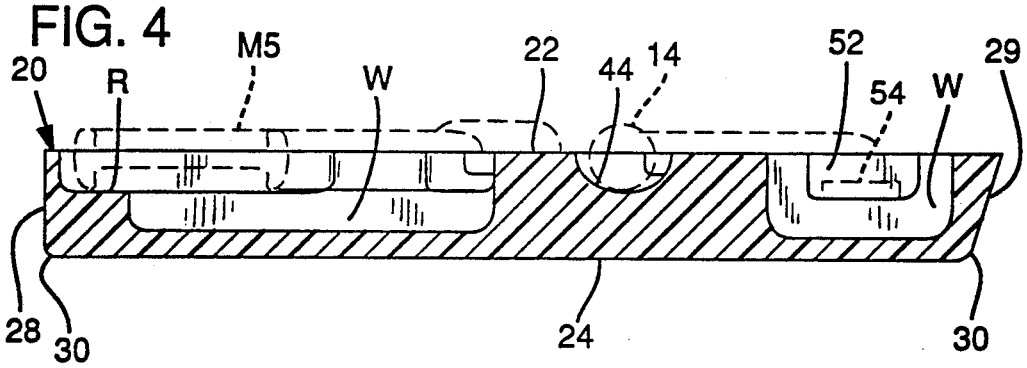
FIG. 4 is an enlarged cross sectional view taken on the line 4—4 of FIG. 3, the micrometers and associated instruments as seen in this view being shown in broken lines.
Figure 6:
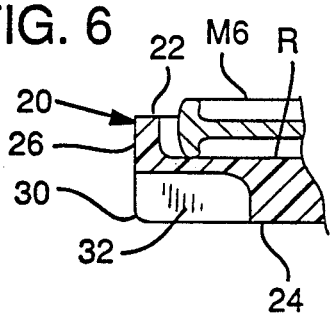
FIG. 6 is a fragmentary sectional view taken on the line 6—6 of FIG. 5 and showing an underside lifting access.
Figure 5:
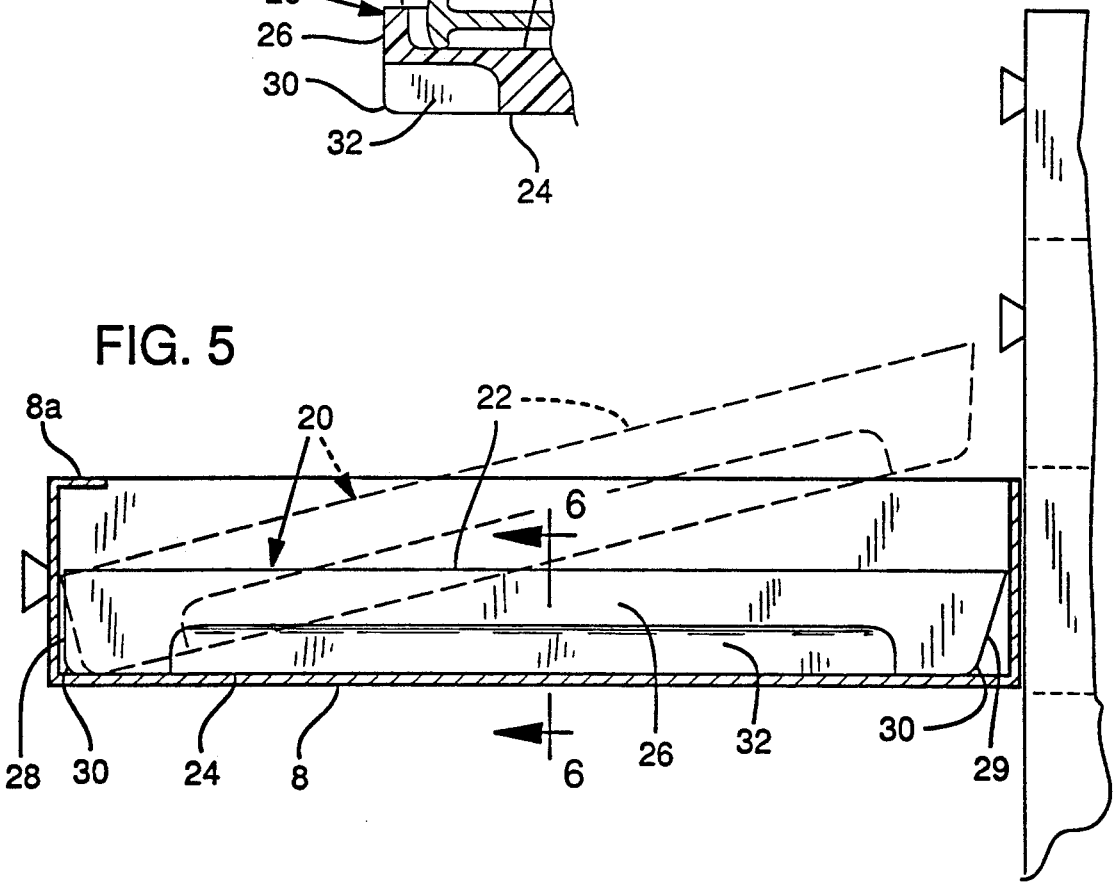
FIG. 5 is a cross sectional view of a conventional tool box drawer showing the present device fully supported in the drawer in full lines and showing the device partly inserted or removed from the drawer in broken lines.

The device comprises a plate-like member or tray 20 having a flat top surface 22, a flat bottom surface 24, and defining end edges 26 and front and rear side edges 28 and 29, respectively. The device has specific width and length dimensions only slightly less than the corresponding internal dimensions of the tool box drawer, namely, approximately 187.325 mm (7⅜") and 625.476 mm (24⅝") respectively. The height or thickness dimension of the device is approximately 22.225 mm (⅞"). The particular width and length dimensions of the device allow for easy insertion into and removal from the drawer but at the same time provide a fairly snug fit. The bottom 30 of the side and end edges of the device, FIGS. 4-6, is radiused slightly to avoid scraping and bunching any felt lining that may exist in the drawers 8. The end edges 26 have bottom notches 32, FIGS. 1, 2, 3, 5 and 6, that form finger grip areas for lifting the device from a smooth surface or for carrying the device. Tapered finger notches 34 are also provided in the rear side edge 29 for pulling the device up or easing it down relative to the cabinet drawer. The rear side edge 29 of the device is tapered slightly inward toward the bottom to facilitate easy insertion into and removal from the drawers, and especially in those drawers that have a front inturned lip 8*a*, FIG. 5, by tipping the holder as shown in broken lines.

Device 20 is constructed with sufficient rigidity, such as from plastic, so as to be free standing when taken out of the drawer or lifted from another supporting surface and held only at its ends by a workman or an automated device.

Top surface 22 includes a plurality of recesses or pockets R for receiving and safely storing the six micrometers M1–M6 in a set from 0–25.4 mm (0–1") through 127.0–152.4 mm (5–6"). These recesses are in continuous ascending size from one end to the other. Each recess R comprises a curved portion 40 that receives the C-shaped frame 10 of the micrometer, a short longitudinal inturned portion 42 for the anvil end 12, and an elongated longitudinal recess portion 44 for the thimble end 14. The recess portion 44 has a reduced-size longitudinal extension 46 at the frame end thereof for receiving the spindle and similarly a reduced size longitudinal extension 48 at the opposite end for receiving the ratchet or friction adjusting mechanism. Each of the recessed portions 44, 46 and 48 is of extended length relative to their associated micrometer parts whereby to accommodate these parts in either their extended or retracted positions.

The recess for micrometer M1 is closely adjacent to one end of the body member and extends generally in a lateral direction closely adjacent to this straight end of the device and parallel therewith. The recess for micrometer M2 is closely adjacent to the first recess and also extends generally in a lateral direction but angled slightly relative to the first recess. The recess for micrometer M3 is closely adjacent to the rear side of the device and extends in a longitudinal direction thereof, the straight side of this recess lying adjacent to and substantially parallel with this side. The recess for micrometer M4 is closely adjacent to the third recess and also extends generally in a longitudinal direction but angled slightly relative to the third recess. The recess for micrometer M5 is spaced from the fourth recess and, similarly to the latter, extends generally in a longitudinal direction and faces the same side as the third and fourth recesses. The recess for micrometer M6 also extends generally in a longitudinal direction but is slightly angled from the fifth recess and reversed in its facing relation relative to the fifth recess.

The particular layout of the recesses for the micrometers is important since only the arrangement shown and described will receive all six micrometers in face up position without the micrometers touching each other and in continuous ascending order from left to right, and from one end to the other within the space confines. Also, the recesses and their extensions are capable of receiving the micrometers in random adjusted positions of the spindles, thus saving time.

Top surface 22 of the device also has auxiliary recesses A that hold calibration standards S for the respective micrometers M2–M6. These recesses are disposed within or partly within the C-shaped portions of the recesses R. In addition, a recess 52 is provided in the surface of the device for holding adjusting wrenches 54.

Recesses R, A and 52 have finger wells W therein that are deeper so as to provide a finger access under the micrometers, standards and wrenches. The finger wells W at the recesses R, with the exception of the one for the largest micrometer, intersect both the micrometer recesses and the calibrating standard recesses A, thus serving as a common finger access for both the micrometer and the calibrating standard. The well W for the largest micrometer M6 recess R is independent from its calibrating standard well W.

Thus, the present invention is a device that supports six most commonly used micrometers in a set and will fit snugly in a conventional tool box drawer but remain readily removable and capable of being free-standing when out of the drawer. The device supports the micrometers in ascending order from one end to the other in a proprietary arrangement such that the six micrometers are all supported in face up and ascending relation within the limited area of a conventional tool box drawer. The micrometers are all supported in spaced relation to prevent damaging contact, excessive wear, and alteration of settings or inconsistent readings due to contact with other micrometers or handling by the workman's warm hand. With the micrometers stored face up, selection time is minimum, and they may be read without handling. The structure of the device provides easy insertion and removal of the micrometers, standards and wrenches. Virtually all micrometers of the type with which the present device is associated may be stored at any spindle setting, due to the excess length of the longitudinal portions of the recess, thus saving considerable time for the user through the elimination of having to reset the spindle to a particular position in order to store it. Adjusting wrenches and calibrating standards are stored in convenient relation on the device.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A holding and organizing device for a set of different sized outside micrometers of the type having a U-shaped frame with an anvil at one end and a thimble at the other end adjustable longitudinally toward and away from the anvil, said device comprising:

a tray having a top surface, opposite sides, and opposite ends, said top surface having a plurality of recesses therein of predetermined sizes each capable of receiving and supporting a micrometer in spaced untouching face up relation relative to each other, said recesses having portions thereof shaped to receive the U-shaped frame, anvil and adjusting thimble of the micrometers and also capable of supporting the micrometers in continuous ascending size from one end to the other, the portion of said recesses that receives the adjusting thimble of the micrometers having a length that allows the micrometer to fit therein with the thimble adjusted to different longitudinal positions.

2. A holding and organizing device for a set of six outside micrometers consisting of sizes of 0–25.4 mm, 25.4–50.8 mm, 50.8–76.2 mm, 76.2–101.6 mm, 101.6–127.0 mm, and 127.0–152.4 mm, said micrometers having a U-shaped frame with an anvil at one end and a thimble and spindle on the other end adjustable toward and away from the anvil, said device comprising:

a tray having a top surface, opposite front and rear side edges, and opposite end edges, said top surface having a width dimension of approximately 187.325 mm and a length dimension of approximately 625.476 mm for removably fitting in a tool box drawer having width and length dimensions of approximately 188.912 mm and 627.064 mm, respectively, said top surface having a plurality of recesses therein of predetermined size capable of receiving and supporting respective micrometers in spaced untouching relation relative to each other, said recesses having a size and selectively being arranged to support the six micrometers in continuous ascending sizes of 0–25.4 mm, 25.4–50.8 mm, 50.8–76.2 mm, 76.2–101.6 mm, 101.6–127.0 mm, and 127.0–152.4 mm, from one end of the tray to the other in face up relation.

3. The device of claim 2 wherein the size and end portions of said tray at the bottom are rounded to prevent damage to tool cabinet drawers upon insertion into and removal of the device from the drawers, finger grip depressions in said end edges for grasping the tray as when picking it up from a flat surface, and finger notches in said rear edge of the tray for pulling the tray up or easing it down relative to a cabinet drawer.

4. The device of claim 2 wherein said recesses comprising two generally lateral similarly facing recesses adjacent one end, two generally longitudinal similarly facing recesses intermediate the two opposite ends, and two generally longitudinally opposite facing recesses adjacent the opposite end.

5. A holding and organizing device for a set of six outside micrometers consisting of sizes of 0–25.4 mm, 25.4–127.0–152.4 mm, said micrometers having a U-shaped frame with an anvil at one end and an adjusting thimble and spindle on the other end, said device comprising:

a tray having a top surface, opposite front and rear side edges, and opposite end edges, said top surface having a width dimension of approximately 187.325 mm and a length dimension of approximately 625.476 mm for removably fitting in a tool box drawer having width and length dimensions of approximately 188.912 mm and 627.064 mm, respectively, said top surface having a plurality of recesses therein of predetermined size capable of receiving and supporting respective micrometers in spaced untouching relation relative to each other, said recess means having a size capable of supporting the six micrometers of continuous ascending sizes of 0–25.4 mm, 25.4–50.8 mm, 50.8–76.2 mm, 76.2–101.6 mm, 101.6–127.0 mm, and 127.0–152.4 mm, from one end of the tray to the other in face up relation, finger wells in said recesses that are engaged by the U-shaped frame of the micrometers, said finger wells intersecting said recesses and being deeper than said recesses to provide a finger access under the frame of micrometers that are supported in the recesses, and a second recess associated with each of the micrometer holding recesses for holding calibrating standards for the respective micrometers, said second recesses also being intersected by finger wells, said finger wells also being deeper than said second recesses to provide a finger access under the calibrating standards when supported in the second recesses.

* * * * *

UNITED STATES PATENT AND TRADEMARK OFFICE

CERTIFICATE OF CORRECTION

PATENT NO. : 5,275,281
DATED : 4 January 1994
INVENTOR(S) : Keith R. Ebeling

It is certified that error appears in the above-identified patent and that said Letters Patent is hereby corrected as shown below:

Col 5, line 21, "size" should read: --side--.

Col 5, line 37, "25.4 127.0-152.4mm," should read:

--25.4-50.8mm, 50.8-76.2mm, 76.2-101.6mm, 101.6-127.0mm, and 127.0-152.4mm,--.

Signed and Sealed this

Sixteenth Day of March, 1999

*Attest:*

*Attesting Officer*

Q. TODD DICKINSON

*Acting Commissioner of Patents and Trademarks*